United States Patent [19]

Smith

[11] 4,199,624

[45] Apr. 22, 1980

[54] TREATMENT OF SUBSTRATE PRIOR TO AUTODEPOSITION

[75] Inventor: Timothy J. C. Smith, Colmar, Pa.

[73] Assignee: Union Carbide Corporation, New York, N.Y.

[21] Appl. No.: 917,505

[22] Filed: Jun. 21, 1978

Related U.S. Application Data

[63] Continuation-in-part of Ser. No. 755,920, Dec. 30, 1976, abandoned.

[51] Int. Cl.[2] ..... B44L 1/98; C23F 7/00; B05D 3/00; B05D 1/18

[52] U.S. Cl. ..... 427/309; 427/327; 427/435; 427/341; 148/6.15 R; 148/6.15 Z

[58] Field of Search ..... 427/309, 435, 327, 341; 204/181; 148/6.15 R, 6.15 Z

[56] References Cited

U.S. PATENT DOCUMENTS

| | | | |
|---|---|---|---|
| 1,109,670 | 9/1914 | Feidt | 148/6.15 R |
| 1,279,101 | 9/1918 | Goravell | 148/6.15 R |
| 2,304,299 | 12/1942 | Boyle et al. | 148/6.15 Z |
| 3,585,084 | 6/1971 | Steinbrecher | 427/435 |
| 3,795,546 | 3/1974 | Hall et al. | 427/309 X |
| 3,973,998 | 8/1976 | Datta et al. | 427/309 X |

FOREIGN PATENT DOCUMENTS

| | | |
|---|---|---|
| 517916 | 2/1940 | United Kingdom . |
| 571976 | 9/1945 | United Kingdom . |

OTHER PUBLICATIONS

Kirk-Othmer, Ency. of Chem. Tech., 2nd Ed., vol. 13, p. 293 (1967).

Burns et al., Protective Coatings for Metals, p. 30 (1955).

*Primary Examiner*—Michael F. Esposito
*Assistant Examiner*—Richard Bueker
*Attorney, Agent, or Firm*—Dale Lynn Carlson

[57] ABSTRACT

A metallic substrate is cleaned and then pretreated with an aqueous acidic solution for the purpose of reducing or preventing the formation of pinholes in a subsequently applied coating formed by an acidic aqueous coating composition containing dispersed particles of an organic coating-forming material and of the type which forms on a metallic surface immersed therein an organic coating which increases in thickness the longer the surface is immersed in the coating composition.

10 Claims, No Drawings

TREATMENT OF SUBSTRATE PRIOR TO AUTODEPOSITION

This application is a continuation in part application of prior application Ser. No. 755,920, filed Dec. 30, 1976, now abandoned.

FIELD OF THE INVENTION

This invention relates to the prevention of pinholing in the formation of organic coatings on metallic surfaces. More specifically, this invention relates to an improvement in the process for depositing an organic coating by contacting a metallic surface with an acidic aqueous coating solution containing dispersed particles of an organic coating-forming material such as resin particles.

A relatively recent development in the coating field is the provision of water-based coating compositions which are effective, without the aid of externally applied electricity, in forming on metallic surfaces immersed therein organic coatings that increase in thickness or weight the longer the time the surfaces are immersed in the compositions. (For convenience, a coating composition of this type is hereafter referred to as an "autodepositing composition" and a coating formed from such a composition is hereafter referred to as an "autodeposited coating"). Speaking generally, compositions which are so effective comprise acidic aqueous coating solutions having dispersed therein particles of an organic material such as resin particles. Autodeposited coatings are formed from such compositions as a result of their ability to attack the metallic surface and generate metal ions in amounts which cause the particles to deposit on the surface in a manner such that there is a continuous buildup of organic coating on the surface.

Coatings formed from such compositions are distinctly different from coatings formed by immersing the metallic surfaces in conventional latices, that is, compositions comprising solid resin particles dispersed in water. The weight or thickness of a coating formed by immersing a metallic surface in a conventional latex is not influenced by the time the surface is immersed in the latex. It is in the main influenced by the amount of resin solids dispersed in the aqueous medium.

Coatings formed from autodepositing compositions are also distinctly different from coatings formed from earlier known acidic aqueous coating solutions containing dispersed solid resin particles and relatively high amounts of water soluble corrosion inhibitors, such as compounds containing hexavalent chromium. The use of relatively high amounts of corrosion inhibitors in such solutions deters attack of the metallic surface to an extent such that resinous coatings which grow with time are not obtained. Thus, resinous coatings formed by immersing metallic surfaces in such compositions are like those formed from immersing the metallic surfaces in conventional latices in that they do not grow with time.

The use of autodepositing compositions offers a number of advantages. For example, autodepositing compositions containing relatively small amounts of coating-forming solids can be used to apply relatively thick organic coatings to metallic surfaces in a relatively short period of time and in a one-step operation. Also, the coating thickness can be controlled by varying the immersion time of the metallic surface in the autodepositing composition. In addition, edges of the metallic substrate can be coated readily. In general, coatings which have good corrosion resistant properties and aesthetic appearance are obtainable. And such coatings can be formed without using electricity, as is required in electrocoating. These are but a few of the advantages which flow from the use of autodeposition, that is, the coating process which involves the formation of autodeposited coatings without the use of electricity.

Although autodepositing compositions are capable of forming organic coatings of excellent quality, it has been observed that under certain conditions where autodepositing compositions of the type which utilize a ferric containing compound are employed, coatings having defects are formed. Such defects appear in the cured coating as pinholes which are present also in the wet uncured coating. Generally, pinholes are defects which appear as round holes in the organic film, approximately 1 to 2 mm. in diameter extending to the metal surface. The term pinholes as used herein is intended to include other versions of the same defect which may appear as craters or blisters. For use in some applications, such defects may be of little or no consequence. However, there are applications where coatings containing such defects would not be tolerable or at least, undesirable. Such defects generally lower the corrosion resistant properties of the coatings. In applications where such properties are important, such coatings would be unsuitable. They would be unsuitable also in applications in which it is desired that the coating appearance comprises a smooth unbroken film.

The present invention relates to reducing or preventing the formation of pinholes in coatings formed from an autodepositing composition of the type that includes a ferric compound.

SUMMARY OF THE INVENTION

In accordance with this invention, a substrate capable of receiving an autodeposited coating is treated with an acid solution prior to subjecting the substrate to an autodepositing composition. Acid pretreating the substrate in accordance with this invention in applications in which an autodepositing composition tends to form coatings having pinholes has been found to be effective in deterring or preventing the formation of pinholes.

Acid pretreatment of the substrate in accordance with the present invention can be accomplished conveniently by contacting the clean metal substrate with a non-coating aqueous solution of acid by spray or immersion.

A variety of acids or mixtures of acids can be used in the pretreatment step. The use of phosphoric acid is particularly preferred.

It is recognized that acid pretreatment of metal surfaces has long been used to clean metal surfaces of undesirable materials such as carbonaceous deposits and metal oxides, for example, scale and rust, prior to subjecting the surfaces to a coating composition. Defects of the type mentioned above have been encountered in autodeposited coatings formed on clean metal surfaces not initially containing such materials, that is, on surfaces which would not ordinarily be subjected to an acid-cleaning pretreatment. Examples below illustrate this.

It is also well known to utilize acid coating compositions to form a conversion coating on the metal surface. Since the autodeposition process depends upon dissolution of the metal substrate for its operation, an inorganic coating pretreatment such as the prior art acid conversion coatings could substantially impede or change the operation of the autodepositing process.

DETAILED DESCRIPTION OF THE INVENTION

As will be seen from the examples reported below, there are autodepositing applications in which defect-free coatings are produced. However, under certain conditions, autodeposited coatings having defects are formed.

One of the factors involved in the formation of coatings having defects is the type of metal surface being treated. Coating defects have been encountered when coating metal surfaces which have been worked, for example, subjected to forming, stamping, bending, drawing, shearing or similar operations. Working of the metal surface generally imparts strains or stresses to the metal and can result in scratching, scoring or galling of the surface. The more highly worked the surface, the greater the tendency for coatings formed thereon to contain defects. In general, the defects are confined to those portions of the coating that overlie the portions of the metal surface that have been worked. For example, in an application in which but a portion of the metal surface has been galled as a result of a stamping operation, defects have been observed in only those portions of the coating that overlie the gall marks; otherwise, the coating is defect-free. The defects have been simulated in laboratory experiments on metal test panels by sanding or abrading with a grinding wheel causing defective coating in only the sanded or abraded areas.

Defects in autodeposited coatings have also been encountered when coating metal surfaces that are in a roughened condition for reasons other than their having been worked. Articles made by a casting operation often have roughened surfaces as a result of the rough surfaces of the walls of the mold in which the article is formed.

Defects in autodeposited coatings formed on metal surfaces of the type described above can take various forms, depending on the particular application involved. For example, the defects may show up as pinholes, blisters and/or craters in the coating. The term "blister" is used to mean a pinhole type defect covered over by a thin coating not adherent to the substrate. (The term "crater", as used herein, refers to a defect that looks like a collapsed blister and is believed to be a pinhole defect with a light adherent coating that appears as a receased spot in the coating surface. In some applications, defects are not observable in the wet unfused coating, but they appear after the coating has been fused by subjecting it to an elevated temperature. In other applications, the wet coating may contain blisters which are converted to pinholes during fusion of the coating at elevated temperatures, or the blisters may remain in the coating after fusion. Still in other applications, pinholes have been observed in the wet, unfused coating.

Process steps used in an autodepositing operation often include subjecting the wet autodeposited coating to rinse steps after the metal article has been contacted with the autodepositing composition. For example, a wet or partially dried coating can be subjected to a water rinse and/or contact with an aqueous chromium-containing solution for the purpose of improving the corrosion resistant properties of the coating. In some applications, the problem is so severe that those portions of the coating overlying the portions of the surface that lead to the aforementioned type defects slough upon contact with the liquid composition, that is, pieces of the coating are removed during the rinse treatment. In such cases, the defect appears as an uncoated portion of the metal surface.

There are a number of factors which play a role in whether or not defects in autodeposited coatings are encountered, and if they are encountered, the extent or degree of their severity. As will be seen from the examples reported below, there are applications in which defects are encountered utilizing a particular type of autodepositing composition, but they are not encountered when utilizing a different type of autodepositing composition. The temperature of the composition, the greater the tendency for defects to be formed. The thickness of the coating can also have an effect in that the greater the thickness, the less likelihood of defect formation. Coating thickness in turn can depend on various factors, such as, for example, the time of contact of the metal surface with the autodepositing composition, the coating-forming solids content of the autodepositing composition, and the temperature of the autodepositing composition.

In any particular application which involves coating of metal surfaces of the type described above, and in which coating defects of the type referred to above are encountered, acid pretreatment of the surface according to the present invention can be used to deter or prevent the formation of such defects. From examples reported below, it will be seen that a wide variety of acids can be used, including organic acids and inorganic acids. Mixtures of acids can be used also. The entirety of the metal surface or only those portions of the surface which give rise to the defect problem can be contacted with the acid pretreating material. Although contact of the metal surface with an acidic material can be accomplished in various ways, it has been found convenient to contact the surface with an aqueous solution of the acid by immersing the metal surface in a bath comprising the aqueous acidic solution.

There are numerous factors involved in determining the effective acid concentration of the pretreating solution. Among such factors are the strength of the particular acid used, the temperature of the pretreating solution, the time of contact between the solution and the metal surface, and the type of metal surface being treated. In view of the numerous variables that are involved, it is suggested that experience in a particular application be used in determine optimum acid concentration and treating conditions. In general, lower temperatures of application and shorter contact times can be used the higher the acid concentration of the solution. Similarly, less concentrated acid solutions can be used with higher temperatures of application and longer contact times.

Acid solutions used in the pinhole preventing pretreatment will have at least about 0.1% by volume of acid, preferably about 2 to 5%, and the temperature of the solution is desirably within the range of about 75° F. to about 200° F., preferably about 100° F. to about 150° F. and the contact time between the solution and the metal surface is about 30 seconds to about 3 minutes.

Whereas effective results have been achieved with solutions containing no more than about 5% by volume of acid. In some cases where the problem is severe and/or where relatively low temperature and short contact times are used, a solution containing 10% by volume of acid may be required. It should be understood that higher concentrations of acid, including undiluted acid, can be used. The acid concentration should not be so high as to adversely affect the metal surface.

It is believed that for most applications, operating within the above parameters will be effective in deterring or preventing the development of coating defects. However, it should be understood that because of the numerous variables involved, as mentioned above, effective results may be achieved by using lower or higher acid concentrations and/or shorter or longer contact times.

Phosphoric acid is particularly preferred for use in the practice of the present invention. Phosphoric acid is relatively safe to handle, relatively non-fuming, and does not give rise to any peculiar waste treatment problems. Also, if some phosphate anion happens to be carried over to the autodepositing bath, its presence therein is relatively innocuous.

When using phosphoric acid, it is recommended that the treating conditions include the use of an aqueous solution comprising about 1 to about 5% by volume of phosphoric acid at a temperature of about 125° to about 160° F. for a contact time of about 1 to about 2 minutes.

Generally, the acid solution used in pretreating worked or roughened metal surfaces in accordance with this invention will have a pH between about 2 and about 3 and preferably about 2. As previously noted, the solution should be non-coating and where an acid having soluble iron salts is utilized, coatings are not formed. Similarly, where a coating forming acid such as phosphoric acid or an acid phosphate is used, the solution is used at a pH at which coatings are not formed.

An optional ingredient that can be used in the acidic solution is a surfactant. Any suitable surfactant that will aid in increasing the wetting of the metal surface by the solution can be used. The surfactant also aids in subsequent rinsing before subjecting the metal surface to the autodepositing process. The surfactant can be used in relatively small amounts, for example, about 0.001 to about 1% by volume of the solution. While compositions of this type containing acid and surfactant can be employed in acid cleaning, the pretreatment of this invention is used after the metal surface has been thoroughly cleaned with a suitable alkaline cleaner. The acid pretreatment of this invention is intended for use only on those surfaces or portions of metal surfaces which owing to surface irregularities caused by working, etc. cause pinholing.

Pretreating the metal surface can also be effective in reducing the tendency of coatings to bridge. Bridging occurs in coatings formed on articles having surfaces which do not lie in the same plane, but which intersect, and appears at the line of intersection. Bridging is evidenced by the pulling away of the coating from the underlying metallic surface at the aforementioned line of intersection.

Coating compositions which are effective in forming autodeposited coatings are known. Examples of such coating compositions are described in U.S. Pat. Nos. 3,585,084, 3,592,699, 3,709,743 and 3,776,848, in British Pat. No. 1,241,991, in South African Pat. No. 72/1146 and in Belgian Patent of Addition No. 811,841.

Speaking generally, the acidic aqueous coating compositions of the aforementioned type function to attack and dissolve from a metallic surface contacted therewith metal ions in an amount sufficient to directly or indirectly cause organic particles in the region of the metallic surface to deposit thereon in a continuous fashion, that is, in a manner such that there is a buildup in the amount of organic material deposited on the surface the longer the time the surface is in contact with the composition. This deposition of the organic material on the metallic surface is achieved through chemical action of the coating composition on the metallic surface. The use of electricity which is necessary for the operation of some coating methods, such as the electrocoating method, is not required.

The pinholing problem has been encountered only in those autodepositing coatings utilizing dissolved ferric iron and the present invention will be used most widely in connection with coatings formed from autodepositing compositions that contain solid particles of resin dispersed in an aqueous solution containing dissolved fluoride and ferric iron of the type disclosed in South African Pat. No. 72/1146. Preferably, the aqueous phase of the coating composition contains surfactant in an amount below the critical micelle concentration (hereafter referred to as "CMC"), and most preferably, the concentration of surfactant in the aqueous phase of the composition is below the surfactant concentration which corresponds to the inflection point on a graph of surface tension versus the logarithm of surfactant concentration in the composition. Preferably, the composition includes an anionic surfactant and the source of the resin dispersion of the composition is a latex containing surfactant in an amount such that the aqueous phase of an autodepositing composition formulated from the latex has a surfactant concentration below the CMC, preferably below the aforementioned inflection point surfactant concentration.

A preferred composition for use in the practice of the present invention is described in U.S. patent application Ser. No. 664,613, now abandoned, filed Mar. 8, 1976, in the name of Wilbur S. Hall, and assigned to the same assignee as the present invention, and incorporated by reference. The preferred composition has a surfactant concentration as described above and a pH of about 1.6 to about 4 and is prepared from water, a ferric-containing compound, most preferably ferric fluoride, in an amount such that it contains the equivalent of about 0.5 to about 3.5 g/l of ferric iron, about 0.2 to about 5 g/l of HF, optionally a pigment such as carbon black, and about 50 to about 125 g/l and higher, e.g. about 150 g/l of resin particles which are all of substantially the same size and substantially chemically homogeneous, that is, each particle is comprised of the same monomeric constituents present in substantially the same proportions or resin particles which are prepared by copolymerizing the following monomers:

(1) about 25 to about 70, and preferably about 40 to about 65 wt. % of a conjugated diene having, for example, 4 to about 9 carbon atoms, such as butadiene or isoprene;

(2) about 5 to about 70, and preferably about 30 to about 65 wt. % of $CH_2{=}CHR$, wherein R is an aryl or a cyano group, for example, styrene or acrylonitrile;

(3) about 1 to about 50, and preferably about 3 to about 15 wt. % of a vinyl halide such as vinyl chloride or vinylidene chloride; and (4) about 0.5 to about 15, and preferably about 1 to about 4 wt. % of a monoethylenically unsaturated monomer having a functional group selected from the class consisting of amide and carboxylic groups, such as acrylamide, methacrylamide, octyl acid maleate and monoethylenically unsaturated monocarboylic and dicarboxylic acids having about 3 to about 12 carbon atoms, and preferably about 3 to about 5 carbon atoms, such as, for example: acrylic acid; cinnamic acid; methacrylic acid; crotonic acid; itaconic acid; maleic acid; and fumaric acid.

The resin is used most conveniently in the form of a latex which can be prepared according to available techniques.

A particularly preferred latex contains particles of resin prepared from the aforementioned monomers, which particles are chemically and physically homogeneous. The resin particles of the preferred latex are prepared from styrene, butadiene, vinylidene chloride and methacrylic acid. In addition, the emulsifier or surfactant content of the preferred latex is about 1 to about 4% based on the resin solids and comprises at least 90 wt. %, most preferably 100 wt. % of an anionic emulsifier such as a sulfonate, for example, sodium dodecylbenzene sulfonate, or a sulfosuccinate, for example, sodium oleoyl isopropanolamide sulfosuccinate, or a mixture thereof.

A highly preferred autodepositing composition has a surfactant concentration as described above and a pH within the range of about 2 to about 3.2 and comprises about 50 to about 125 g/l of resin solids, ferric fluoride, in an amount equivalent to about 0.5 to about 2 g/l of ferric iron, and about 0.7 to about 3 g/l of HF.

As to the cause of coating defects in autodeposited coatings, it is believed that those portions of a metal surface which have been worked are more sensitive to the coating composition than portions which have not been worked. In other words, it is believed that the worked portions of the surface are more highly reactive and are more readily attacked by the coating composition with the result that, at these portions, hydrogen ion is reduced to hydrogen in amounts greater than that generated at other less reactive portions of the surface. It is believed that excessive amounts of hydrogen are also produced when coating roughened surfaces of the type mentioned above and also when coating surfaces of the type that lead to bridging defects.

In severe applications involving the coating of worked or roughened surfaces where relatively high amounts of hydrogen are generated, defects such as pinholes are evident in the wet or uncured coating. In less severe applications, it appears that the hydrogen remains entrapped beneath or within the coating until the coating is cured or fused at elevated temperature at which time the hydrogen expands. Depending on various factors, the hydrogen may cause pinholes to be formed in the coating.

It is believed that acid pretreatment of the surfact deactivates the relatively reactive portions of the surfact, thus, deterring or preventing the generation of excessive hydrogen, which in turn leads to the formation of improved quality coatings. Generally metal surfaces which are scratched, scored, abraded or have other surface disfigurations are the most reactive. The problem occurs even though the surfaces are free of soils of the type which are removed by acid cleaning.

As mentioned above, one of the factors involved in the development of coating defects is the temperature at which the autodepositing composition is contacted with the metal surface. In this connection, it is noted that autodepositing compositions are effective in forming coatings on metal surfaces over a wide temperature range, including temperatures approaching the boiling point of the composition and temperatures approaching those at which the dispersed organic coating-forming particles are undesirably coagulated. There are advantages in operating at elevated temperatures. Speaking generally, the higher the temperature of the composition, the greater the rate of the coating formation or film build. Thus, at higher temperatures the shorter the time required to produce coatings of a given thickness. On the other hand, the use of higher temperatures usually leads to a more aggravated condition of coating defects when coating metal surfaces of the type that are prone to this problem. In a co-pending application, Ser. No. 608,967 filed on Aug. 29, 1975, now abandoned, there is disclosed a method for preventing surface defects in autodepositing processes by carefully controlling the temperature of the coating bath at a temperature below about 80° F. The present process can be used in conjunction with temperature control or in cases where it is desirable to operate at elevated temperatures. One of the advantages of the present invention is that it enables the effective use of an autodepositing coating composition at a temperature that might otherwise be avoided because the use of such temperature, in the absence of acid pretreatment, would normally lead to the formation of coating defects. Thus the present invention enables the use of higher temperatures for more rapid and heavier film build free of pinholes.

Although the coating composition can be contacted with the metal surface in a variety of ways, including, for example, by spraying and flow coating, it is believed that the most widely used method of contact will comprise immersing the metal surface in the coating composition at ambient temperatures and preferably at about room temperature. As mentioned above, the longer the metal surface is immersed in the coating composition, the greater the build-up in coating thickness. It is believed that for most applications, desired coating thicknesses can be obtained by immersing the metal surface in the composition for a period of time within the range of about 30 seconds to about 3 minutes. However, it should be understood that longer or shorter periods of time can be used.

Agitating the composition aids in maintaining it uniform. Also, agitation of the composition is effective in improving the uniformity of the coatings formed.

Various factors should be taken into account in determining whether the metal surface should or should not be cleaned, and the extent of cleaning, prior to contact with the autodepositing composition, including, for example, the nature of foreign materials (if any) on the surface and the desired quality of the coating. Foreign materials which are present on the metal surface can lead to the formation of coatings which are not uniform. Also, the adhesion and corrosion resistant properties of the resinous coatings can be affected adversely as a result of the presence on the metal surface of foreign materials during the coating step. Generally speaking, improved quality coatings can be consistently obtained the cleaner the surface. Excellent results can be achieved consistently by subjecting the metal surface to a cleaning operation which results in a surface on which there can be formed a water break-free film. The selection of the cleaning agent and mode of application thereof to the metal surface will depend on the type of foreign materials present on the metal surface. Available cleaning agents can be used in accordance with known technology. Thus, depending on the type of soil or foreign materials which are present, acidic, alkaline or other cleaning agents can be used. By way of example, dilute phosphoric acid can be used to clean lightly rusted parts and hot alkaline compositions can be used for the removal of oils, greases, fingerprints and other organic deposits.

The nature of the deposits on the metal surface may be such that acid pretreatment according to the invention may not be effective in removing them. In any event, it is preferred that the metal surface be clean when subjected to acid pretreatment according to the present invention.

After contact with the autodepositing composition, the coated metal surface can be subjected to further processing steps as are known. Such steps are described briefly hereafter.

Water rinsing the coated surface after it has been withdrawn from the composition, and before significant drying takes place is effective in removing therefrom residuals such as acid and other ingredients of the bath that adhere to the coated surface. If such residuals are allowed to remain on the coated surface, they may change or adversely affect the quality of the coating. For a specific application, a determination can be made as to whether the residuals cause adverse effects which are not tolerable. If they do, they should be removed, for example, by water rinsing with tap or deionized water. If they do not, this step of removing them can be avoided.

If desired, the corrosion resistant properties of the coated surface can be improved by contacting the coated surface with an acidic aqueous rinse solution containing hexavalent chromium. Such rinse solutions can be prepared from chromium trioxide or a water soluble dichromate or chromate salt, for example, ammonium, sodium and potassium salts. There can also be used a chromium composition obtained by treating a concentrated aqueous solution of chromic acid with formaldehyde to reduce a portion of the hexavalent chromium. This type of rinse composition, which is described in U.S. Pat. No. 3,063,877 to Schiffman, contains chromium in its hexavalent state and reduced chromium in aqueous solution. It has been reported also that the water and salt spray resistance of a fused resinous coating can be improved by contacting the unfused coating with a solution, preferably an aqueous solution, of phosphoric acid (see U.S. Pat. No. 3,647,567). The recommended amount of phosphoric acid in the solution is about 0.25 to about 7 wt. % based on the total weight of the solution.

Following any rinse steps employed after the coated surface is withdrawn from the composition, the coating should be dried. Fusion of the resinous coating renders it continuous, thereby improving its resistance to corrosion and adherence to the underlying metal surface.

The conditions under which the drying and/or fusion operation is carried out depend somewhat upon the type of resin employed. In general, heat will be required to fuse the resin. The corrosion resistant properties of coatings fused at elevated temperature have been observed to be better than coatings which have been air dried. However, there are applications where air dried coatings can be used satisfactorily. The fusion of the coating should be carried out below temperatures which cause the resinous coating to degrade. Exemplary conditions used in fusing coatings produced according to the present invention are temperatures within the range of about 100° to about 200° C. for periods of time within the range of about 10 to about 30 minutes, depending on the mass of the coated part. Baking the coating for a period of time until the metal surface has reached the temperature of the heated environment has been used effectively.

EXAMPLES

The first group of examples shows the acid pretreatment of metal articles according to the present invention and the application thereto of autodeposited coatings. For comparative purposes, this group of examples shows also the pretreatment of metal articles with alkaline cleaning materials.

Each of the articles used in this group of examples was made from hot rolled steel sheet that was dished by stamping. The articles contained gall marks along the junction of the dished and lip portions on the convex side of the articles. The articles were soiled with forming oil and shop dirt, but they were not rusted. Soils of this type would generally be removed by cleaning the articles with alkaline cleaning solutions.

Acid pretreating solutions were prepared from the following composition.

Composition A

| Ingredients | Amount wt. % |
|---|---|
| phosphoric acid (75 wt. %) | 33.5 |
| butylether of ethylene glycol (butyl Cellosolve) | 7.9 |
| nonyl phenol ethoxylate (Triton N-100) | 0.5 |
| sodium alkyl benzene sulfonate (UltraWet 45DS) | 0.3 |
| oleyl alcohol (technical grade) | 0.1 |
| water | 57.7 |

The pretreating solutions and the application conditions used are identified in Table 1 below.

TABLE 1

| Ex. | Pretreating Material | Amt. of Pretreating Material in Aqueous Pretreating Solution | Application Conditions |
|---|---|---|---|
| 1 | Comp. A above | 1 part by vol. to 2 parts by vol. of water | 3 min. immersion at 110° F. |
| 2 | pretreating solution of Ex. 1 plus 2.5% by volume of 21 wt. % HF | | 3 min. immersion at 110° F. |
| C-1 | strongly alkaline spray cleaner[1] | 2 oz/gal | 3 min. spray at 160° F. |
| C-2 | pretreating solution of Ex. C-1 plus 1% by volume of an aqueous solution of 38 wt. % $NH_3$ | | 3 min. spray at 160° F. |

TABLE 1-continued

| Ex. | Pretreating Material | Amt. of Pretreating Material in Aqueous Pretreating Solution | Application Conditions |
|---|---|---|---|
| C-3 | chlorinated alkaline cleaner[2] | 2 oz/gal | 3 min. spray at 160° F. |
| C-4 | oxygenated alkaline cleaner[3] | 2 oz/gal | 3 min. spray at 160° F. |
| C-5 | strongly alkaline immersion cleaner[4] | 6 oz/gal | 5 min. immersion at 190° F. |
| C-6 | pretreating solution of Ex. C-5 plus 1% by wt. of Glucoquest AC (sodium alpha gluco heptonate) | | 3 min. immersion at 160° F. |
| C-7 | pretreating solution of Ex. C-5 plus 1% by vol. of Hampenol OH-1 (ethylenediamine tetra-acetic acid type chelate for iron) | | 3 min. immersion at 160° F. |
| C-8 | caustic gluconate type deruster[5] | 1 lb/gal | immersion at 190° F. (time not recorded) |

[1]sold by Amchem Products, Inc. under the trademark Ridoline 5290; a powder mixture of caustic soda, soda ash, sodium orthosilicate and surfactant (phosphate-free)
[2]powder cleaner available from Amchem Products, Inc. as RL 69-364
[3]powder cleaner containing sodium perborate and available from Amchem Products, Inc. as RL-69-390
[4]sold by Amchem, Inc. under the trademark Ridoline 27; a powder mixture of sodium tripolyphosphate, caustic soda, sodium gluconate and wetting agent
[5]powder cleaner sold by Amchem Products, Inc. under the trademark Ridoline 32

The articles treated with the acid pretreating solutions of Examples 1 and 2 above were first cleaned with the alkaline cleaning solution of Example C-5 above by immersing the articles in the cleaning solution for 5 minutes at a temperature of 160° F. The cleaned articles were then rinsed with tap water and thereafter subjected to the solutions of Examples 1 and 2.

After subjecting the articles to the pretreating solutions identified in Table 1, they were rinsed by immersion for about 30 seconds in agitated tap water and then further rinsed with an aerated 5 second spray of deionized water. Thereafter, the articles were coated by immersing them for about 90 seconds in an 800 gallon bath of a stirred autodepositing composition comprising, on a 1 liter basis:

latex containing about 54% solids: 180 g
ferric fluoride: 3 g
hydrofluoric acid: 2.1 g
black pigment dispersion: 5 g
water: to make 1 liter.

The resin of the latex used in the above composition comprised about 62% styrene, about 30% butadiene, about 5% vinylidene chloride and about 3% methacrylic acid. A film formed from the resin is soluble in refluxing chlorobenzene to the extent of about 13%. That the resin is cross-linked is indicated by its insolubility in Soxhlet extraction with chlorobenzene. The water soluble content of the latex is about 2% based on the weight of dried resin, with the water soluble content comprising about 10% sodium phosphate, about 13% sodium oleoyl isopropanolamide sulfosuccinate and about 75% sodium dodecylbenzene sulfonate, the first mentioned ingredient being a buffering agent used in preparing the latex, and the last 2 mentioned ingredients being emulsifiers. The pH of the latex was about 7.8 and the surface tension thereof about 45–50 dynes/cm. The average particle size of the resin was about 2,000 A.

The black pigment dispersion used in the above composition is an aqueous dispersion having a total solids content of about 36%. Carbon black comprises about 30% of the dispersion. It has a pH of about 10–11.5 and a specific gravity of about 1.17. The dispersion contains a nonionic dispersing agent for the solids, and is sold under the trademark Aquablak 115.

After the resinous coated articles were withdrawn from the autodepositing composition, they were air-dried for about one minute, immersed in tap water for about 30 seconds, and thereafter immersed in an aqueous chromium-containing solution for about 30 seconds. (The chromium-containing solution was an aqueous solution containing 0.1% by volume of an aqueous solution of a surfactant, namely an aqueous solution of octyl phenol ethoxylate sold under the trademark Triton X102, and 3% by volume of an aqueous chromium-containing concentrate containing about 8.6 wt.% $CrO_3$, about 8.6 wt.% formaldehyde-reduced $CrO_3$ and about 3.9 wt.% phosphoric acid.) After rinsing with the chromium solution, the articles were placed in a forced air draft oven having a temperature of about 275° F. for about 20 minutes to fuse the resin coating.

Upon withdrawal from the oven, examination of the coated articles showed that the coatings of the articles pretreated with the solution of Examples C-1 to C-8 contained hundreds of pinholes which extended through the coating to the underlying metal surface. The pinholes were located in those portions of the coatings that overlay the gall marks on the articles. On the other hand, the coatings of the articles that were treated in accordance with the present invention (pretreating solutions of Examples 1 and 2), contained but a few pinholes which were located in some of the portions of the coatings that overlay some of the gall marks. Thus, pretreatment of the articles according to the present invention resulted in a vast improvement in deterring pinhole formation.

Unless stated otherwise, various of the process steps used in the above examples were used also in the examples which follow, that is, there were used in the following examples, the same water rinse steps following alkaline cleaning, the same water rinse steps following acid cleaning, the same autodepositing composition and application conditions, the same air-dry conditions, the same water and chromium rinse steps following autodeposition and the same baking conditions. In all of the examples, the autodepositing compositions used had a temperature in the range of about 72° F. to about 75° F.

The next group of examples (Example Nos. 3, 4 and 5) shows the results obtained when alkaline cleaning of metal surfaces was either preceded or followed by acid pretreatment, and also the results obtained with acid pretreatment only. In this group of examples, the following acid pretreating solution was used.

| Pretreating Solution A | |
|---|---|
| $H_3PO_4$ (85 wt. %) | 5.0% by volume |
| HF (21 wt. %) | 2.5% by volume |
| nonyl phenol ethoxylate (Triton N-100 | 1.0% by volume |
| defoaming agent (Makon NF 12) | 1.0% by volume |

The metal articles used in Examples 3, 4 and 5 were of the same type as those used in the preceding examples.

EXAMPLE 3

The article was cleaned by immersing it in an alkaline cleaning solution like that of Example C-5 in Table 1 above at 160° F. for 5 minutes. The cleaned article was then sprayed with acid penetrating solution A above at 160° F. for 3 minutes. Examination of the autodeposited coated article after the baking steps revealed that the coating contained no pinholes.

EXAMPLE 4

The article was sprayed with acid pretreating solution A above for 3 minutes at 160° F. and then subjected to alkaline cleaning as described in Example 3. Examination of the autodeposited coated article after the baking step revealed that the coating contained no pinholes.

EXAMPLE 5

The article was sprayed with acid pretreating solution A above for 3 minutes at 160° F. Examination of the autodeposited coated article after the baking step showed that although the coating contained some pinholes, the number of pinholes was far less than obtained when acid pretreatment was not used.

The next group of examples (Examples 6 to 12) includes the acid pretreatment of articles of the type described in the preceding examples for various periods of time and shows the results obtained. Each of the articles used in this series of tests was cleaned initially by soaking the article for 5 minutes in an alkaline cleaning solution prepared in accordance with Example C-5 of Table 1 and having a temperature of 160° F. Table 2 below sets forth the acid pretreating solutions used and the times of immersion of the articles in the solutions. Each of the solutions was maintained at a temperature of 160° F.

TABLE 2

| | Acid Pretreating Solution | | | | |
|---|---|---|---|---|---|
| Ex. | $H_3PO_4$, 85 wt. %, % by vol. | Surfactant,* % by vol. | HF, 21 wt. %, % by vol. | Immersion Time, Min. | Results |
| 6 | 5% | 0.1% | 1% | 1 | Pinholes |
| 7 | 5% | 0.1% | 1% | 2 | No Pinholes |
| 8 | 5% | 0.1% | 1% | 3 | No Pinholes |
| 9 | 5% | 0.1% | None | 3 | No Pinholes |
| 10 | 10% | 0.1% | None | 1 | Pinholes |
| 11 | 1% | 0.1% | None | 1 | Pinholes |

TABLE 2-continued

| | Acid Pretreating Solution | | | | |
|---|---|---|---|---|---|
| Ex. | $H_3PO_4$, 85 wt. %, % by vol. | Surfactant,* % by vol. | HF, 21 wt. %, % by vol. | Immersion Time, Min. | Results |
| 12 | 1% | 0.1% | 1% | 1 | Pinholes |

*sold under the trademark Triton X102 and containing octyl phenol ethoxylate

With respect to Examples 6, 10, 11 and 12 above, it was observed that the resinous coatings, in addition to containing pinholes, also sloughed, that is, those portions of the coatings overlying the gall marks were so loose that pieces of the coatings came off the articles when the articles were subjected to the water and chromium rinse steps that followed the withdrawal of the articles from the autodepositing composition. Examples in Table 2 above illustrate that the length of time the article is subjected to the acid pretreating solution can influence the results obtained.

The next group of examples includes the corrosion resistant ratings of autodeposited coatings formed on substrates, some of which were acid pretreated and others of which were not. The substrates used were cold rolled steel panels (unpolished Q panels) which were free from score marks and other characteristics that generally lead to the formation of pinholes in autodeposited coatings. The panels were first cleaned by immersing them for 2 minutes in an aqueous alkaline cleaning solution having a temperature of 150° F. and containing 4 oz/gal of the alkaline immersion cleaner of Example C-5 in Table 1 above. The acid pretreating solutions used had a temperature of 160° F. and consisted of an acidic aqueous solution containing 5% by volume of phosphoric acid (85 wt. %) and 0.17% by volume of a surfactant sold under the trademark Triton X102 and containing octyl phenol ethoxylate. The autodepositing composition used was like the composition described above in connection with the previous examples, except that the concentrations of the latex and $FeF_3$ were respectively about 150 g/l and about 2.2 g/l. The resinous coatings were fused by placing the coated articles for 10 minutes in an oven having a temperature of about 140° C. The immersion times of the panels in the acid pretreating solutions and in the autodepositing coating composition are set forth in Table 3 below. For each example, 3 panels were subjected to the above described process steps and then to the salt spray tests identified in Table 3. The corrosion resistant ratings set forth in Table 3 are the average of the 3 ratings obtained. The ratings are on a 0 to 10 scale, with the number "10" representing a perfect coating.

TABLE 3

| | | | Salt Spray Test ASTM B-117 5% at 95° F. 336 hours | |
|---|---|---|---|---|
| Ex. | Time of Immersion In Acid Pretreating Solution, in min. | Time of Immersion in Autodepositing Comp. in min. | Scribe Failure | Field |
| 13 | 0 | 1 | 6.3 | 5.0 |
| 14 | 2 | 1 | 7.3 | 6.3 |
| 15 | 3 | 1 | 7.0 | 5.3 |
| 16 | 0 | 2 | 7.8 | 7.6 |
| 17 | 2 | 2 | 8.0 | 2.3* |
| 18 | 3 | 2 | 7.1 | 8.3 |

*This rating was considered anomalous and was not explainable. The ratings for the three panels were 0, 0 and 7.

It can be seen from Table 3 above that acid pretreatment did not in general adversely affect the corrosion resistant properties of the coated panels. Indeed, improvements in corrosion resistance were realized in most cases.

The next series of tests illustrate how scratch marks on metal surfaces promote the formation of pinholes in autodeposited coatings. Cold rolled steel panels (unpolished Q panels) and hot rolled steel panels were scratched by sanding them with a belt sander equipped with a 60 grit emery cloth. The scratched panels were cleaned by immersing them for 1 to 5 minutes in an alkaline cleaning solution having a temperature of 160° F. and containing 4 oz/gal of an alkaline cleaner sold under the trademark Ridoline 1727. The panels were then acid pretreated by immersing them for 3 minutes in an aqueous acidic pretreating solution having a temperature of 160° F. and containing 5% by volume of $H_3PO_4$ (85 wt.%) and 0.1% by volume of a surfactant sold under the trademark Triton X102 and containing octyl phenol ethoxylate. Thereafter, the scratched panels were immersed for 90 seconds in an autodepositing composition like the composition described in connection with Examples 1 and 2. The coated panels were subjected to a different aqueous chromium rinse than the one described previously in that it comprised 3% by volume of an aqueous chromium-containing concentrate comprised of 150 g/l of $Na_2Cr_2O_7.2H_2O$ and a mixture of $Cr^{+6}$/formaldehyde-reduced Cr in an amount such that the total Cr concentration from the mixture in the concentrate was 50 g/l with about 50 wt.% of the Cr in reduced form, and 25 g/l of 75 wt.% $H_3PO_4$. The coatings of the cold rolled steel panels and those of the hot rolled steel panels were cured in an oven having a temperature of 160° F. for 15 and 20 minutes respectively. For comparative purposes, the same process steps as described above were used in treating other of the aforementioned panels except that some of the panels were neither sanded nor acid pretreated and still others were sanded, but not acid pretreated. There are set forth in Table 4 below the results of the tests.

TABLE 4

| Ex. | Panel Type | Sanded | Acid Pretreated | Pinholes |
|---|---|---|---|---|
| 19 | CRS* | No | No | None |
| 20 | CRS | Yes | No | Many |
| 21 | CRS | Yes | Yes | None |
| 22 | HRS** | No | No | Trace |
| 23 | HRS | Yes | No | Moderate |
| 24 | HRS | Yes | Yes | Trace |

*cold rolled steel panel
**hot rolled steel panel

With respect to Table 4 above, the pinholes that were present in the autodeposited coatings were in those portions of the coatings that overlay the scratched areas of the panels. From Table 4, it can be seen how scored areas lead to the formation of pinholes and the effectiveness of the present invention in eliminating or deterring the formation of such coating defects.

The next group of examples shows the use of a variety of acidic compositions for acid pretreating metal surfaces in accordance with the present invention. In this group of examples, there were used the same type of sanded cold rolled steel panels and sanded hot rolled steel panels and the same process steps as described above in connection with Examples 19 to 24. The particular aqueous acidic pretreating solutions used are set forth in Table 5 below. In addition to the ingredients of the solutions identified in Table 5 below, all of the solutions except the acetic and monosodium phosphate solutions contained 0.1% by volume of surfactant (Triton X102). The panels were immersed in the solutions for 3 minutes at a temperature of 160° F.

TABLE 5

| Ex. | Panel Type | Aqueous Acid Pretreating Solution | Pinholes |
|---|---|---|---|
| 25 | CRS* | 50 ml/l of 98 wt. % $H_2SO_4$ | None |
| 26 | HRS** | " | None |
| 27 | CRS | 50 ml/l of 37 wt. % HCl | None |
| 28 | HRS | " | None |
| 29 | CRS | 50 ml/l of 49 wt. % HF | None |
| 30 | HRS | " | None |
| 31 | CRS | 50 ml/l of 99 wt. % acetic acid | None |
| 32 | HRS | " | None (1). |
| 33 | CRS | 50 g/l of citric acid monohydrate | None |
| 34 | HRS | " | None |
| 35 | CRS | 50 g/l of oxalic acid dihydrate | None |
| 36 | HRS | " | None |
| 37 | CRS | 25 g/l of $NaH_2PO_4 . H_2O$ | None |
| 38 | HRS | " | trace (1) |

*cold rolled steel panel
**hot rolled steel panel
(1) some craters

The examples of Table 5 illustrate the effectiveness of various types of acidic materials, including inorganic and organic acidic materials, in the acid pretreatment process of the present invention. It should be understood that the abovementioned acids are exemplary and that other acids may be used. Examples of still other acidic materials that can be used include tartaric acid, sulfamic acid, sodium bisulfate and nitric acid.

EXAMPLE 39

This example illustrates the non-coating nature of the acid treatment of this invention.

Unpolished Q-panels of cold rolled steel measuring 6 in. × 3 in. were cleaned with an alkaline cleaner containing sodium tripoly phosphate, caustic soda and wetting agent and available as Ridoline 1727, at 4 oz.gal. and 160° F., as in the case of examples 19 to 24 above then acid pretreated with a solution containing 5% by volume phosphoric acid and 0.1% by volume of Triton X102. The acid pretreatment consisted of a 3 minute immersion at 160° F. The panels were rinsed and dried and weighed after each treatment. The acid treated panels were then subjected to the usual conditions for stripping phosphate coatings by immersing them in a 5% chromic acid solution at 150° F. for 5 minutes, after stripping the panels were rinsed, dried and weighed and the etch rate and coating weight were determined for each panel from the weight differences. Blank panels were cleaned and treated with the stripping solutions to determine the weight loss from the stripping treatment. The results were as follows:

| | No. 1 | No. 2 |
|---|---|---|
| Weight of clean panel | 74.2656 g. | 74.2454 g. |
| Weight after acid treatment | 74.2092 g. | 74.1806 g. |
| Weight after stripping | 74.2087 g. | 74.1801 g. |

The weight loss on two blank panels was 2.8 mg/ft$^2$ and 4 mg/ft$^2$, respectively. The etch rate on the two test panels cleaned, acid treated and stripped as above, was determined as 75.2 mg/ft$^2$/min and 86.4 mg/ft$^2$/min, respectively. The possible coating weight for each of the two test panels represented by the weight loss in stripping was 2 mg/ft$^2$ in each case which is less than the experimentally determined weight loss on the blanks and accordingly within the detection limits of the test. No coating was produced by the acid treatment. Phosphate coatings are typically on the order of 30 mg/ft$^2$ or higher.

Treatments with acids which have soluble iron salts such as, for example, hydrochloric acid or trichloracetic acid cannot form insoluble conversion coatings under the conditions specified for the acid treatments of this invention.

In addition to pretreating ferriferous surfaces of the type exemplified above, the present invention is applicable to other metal surfaces, including, for example, zinc and aluminum.

In summary, it can be stated that the present invention provides an effective way for improving the quality of autodeposited coatings, as is exemplified in many of the examples reported above.

I claim:

1. In a coating process wherein an autodeposited coating is formed on a metal surface by contacting said surface with an autodepositing coating composition comprising an acidic aqueous solution containing dissolved fluoride and ferric iron and having resin solids dispersed therein and wherein the nature of said metal surface is at least partly roughened or worked such that the cured autodeposited coatings formed on such metal surface from said composition contain defects, the improvement comprising pre-treating such metal surface which is substantially free of soils of the type that are removed by acid cleaning with a non-coating forming aqueous acid solution prior to contacting said surface with said autodepositing composition to prevent the formation of pinholes in the cured autodeposited coating.

2. A process for coating metal surfaces with an autodepositing coating composition comprising:

(A) treating a worked or roughened metal surface which is free of acid removable solid with an alkaline cleaning solution; and thereafter (B) treating said cleaned metal surface with a non-coating forming aqueous acid solution; and thereafter (C) treating said acid treated metal surface with an autodepositing coating composition comprising an acidic aqueous solution containing dissolved fluoride and ferric iron and having resin solids dispersed therein.

3. A process according to claim 2 wherein said aqueous acid solution contains about 1 to about 5% by volume of phosphoric acid and said metal surface is contacted with said acid solution at a temperature of about 125° F. to about 160° F. for a period of time of about 1 minute to about 2 minutes.

4. A process for coating metal surfaces with an autodepositing coating composition comprising:

(A) treating a worked or roughened metal surface which is substantially free of rust, scale, corrosion products and other acid removable soils with a non-coating forming aqueous acid solution; and thereafter (B) treating said cleaned metal surface with an autodepositing coating composition comprising an acidic aqueous solution containing dissolved fluoride and ferric iron and having resin solids dispersed therein to form a continuous organic coating on said metal surface.

5. A process according to claim 4 wherein said aqueous acid solution contains between about 1% and about 10% by volume of an acid selected from the group consisting of phosphoric acid, sulfuric acid, hydrochloric acid and hydrofluoric acid and mixtures thereof.

6. A process according to claim 4 wherein said aqueous acid solution contains about 1 to about 5% volume of phosphoric acid and said metal surface is contacted with said acid solution at a temperature of about 125° F. to about 160° F. for a period of time of about 1 minute to about 2 minutes.

7. A process according to claim 6 wherein said worked or roughened metal surface is cleaned with an alkaline cleaning solution prior to treating with said aqueous acid solution.

8. A process according to claim 7 wherein the coated metal surface is treated with an aqueous chrome rinse solution following the formation of the autodeposited coating on the metal surface.

9. A process according to claim 8 wherein said aqueous acid solution contains between about 0.1% and about 1% by weight of surfactant.

10. A process according to claim 4 wherein said aqueous acid solution comprises a solution of sodium dihydrogen phosphate in an amount of about 25 grams per liter of aqueous acid solution.

* * * * *

UNITED STATES PATENT AND TRADEMARK OFFICE

CERTIFICATE OF CORRECTION

PATENT NO. : 4,199,624

DATED : April 22, 1980

INVENTOR(S) : Timothy J. C. Smith

It is certified that error appears in the above-identified patent and that said Letters Patent are hereby corrected as shown below:

On the cover page of the patent, in the lines identified by "[73] Assignee:", for "Union Carbide Corporation, New York, N.Y." read --Amchem Products, Inc., Ambler, Pa.--.

On the cover page of the patent, under heading "[56] References Cited", second reference, for "Goravell" read --Gravell--.

Column 13, line 17, after "N-100" insert --)--.

Column 13, line 27, for "penetrating" read --pretreating--.

Column 16, line 41, for "4oz.gal." read "4 oz./gal.--.

Signed and Sealed this

*Twenty-ninth* Day of *July 1980*

[SEAL]

*Attest:*

SIDNEY A. DIAMOND

*Attesting Officer*

*Commissioner of Patents and Trademarks*